US011440160B2

(12) United States Patent
Brown et al.

(10) Patent No.: US 11,440,160 B2
(45) Date of Patent: Sep. 13, 2022

(54) GUARDS FOR USE WITH POWER TOOLS AND POWER TOOLS INCLUDING SUCH GUARDS

(71) Applicant: PAUL MUELLER COMPANY, Springfield, MO (US)

(72) Inventors: Robert Aaron Brown, Springfield, MO (US); Daniel Chronister, Springfield, MO (US); David Moore, Springfield, MO (US); William Hewett, Springfield, MO (US); Gregg Shirey, Springfield, MO (US)

(73) Assignee: PAUL MUELLER COMPANY, Springfield, MO (US)

( * ) Notice: Subject to any disclaimer, the term of this patent is extended or adjusted under 35 U.S.C. 154(b) by 797 days.

(21) Appl. No.: 16/105,253

(22) Filed: Aug. 20, 2018

(65) Prior Publication Data

US 2019/0291241 A1 Sep. 26, 2019

Related U.S. Application Data

(60) Provisional application No. 62/647,312, filed on Mar. 23, 2018.

(51) Int. Cl.
*B24B 55/05* (2006.01)
*B24B 23/02* (2006.01)

(52) U.S. Cl.
CPC ..... *B24B 55/052* (2013.01); *B24B 23/028* (2013.01)

(58) Field of Classification Search
CPC ..... B24B 55/052; B24B 55/04; B24B 55/102; B24B 23/022; B24B 23/028; B24B 23/02; B24B 55/00; B24B 27/08
USPC ..... 451/451, 452
See application file for complete search history.

(56) References Cited

U.S. PATENT DOCUMENTS

| | | | | |
|---|---|---|---|---|
| 3,068,620 | A * | 12/1962 | Tocci-Guilbert | B24B 55/05 451/451 |
| 4,059,930 | A | 11/1977 | Alessio | |
| 6,699,114 | B1 * | 3/2004 | Booeshaghi | B23Q 1/52 451/451 |
| 6,896,605 | B2 * | 5/2005 | Ohlendorf | B24B 23/02 451/359 |
| 6,988,939 | B2 | 1/2006 | Hofmann et al. | |
| 2003/0119435 | A1 * | 6/2003 | Ohlendorf | B24B 23/02 451/454 |
| 2013/0000935 | A1 * | 1/2013 | Kelleher | B24B 23/028 173/46 |
| 2015/0104998 | A1 * | 4/2015 | Fuller | B24B 23/03 451/28 |
| 2016/0039068 | A1 | 2/2016 | Morris et al. | |
| 2018/0264622 | A1 * | 9/2018 | Arthur | B27G 19/04 |

* cited by examiner

*Primary Examiner* — Joel D Crandall
(74) *Attorney, Agent, or Firm* — Steptoe & Johnson LLP; Benjamin Holt

(57) ABSTRACT

Example guards for use with power tools and power tools including such guards. The guards include a collar structured to be removably coupled to a hand-guided electrical tool, a hood coupled to the collar, and a guard ring coupled to the collar via the hood. The guard ring extends entirely around the collar.

8 Claims, 13 Drawing Sheets

GUARDS FOR USE WITH POWER TOOLS AND POWER TOOLS INCLUDING SUCH GUARDS

RELATED APPLICATION

This patent claims priority to U.S. Provisional Patent Application No. 62/647,312, which was filed Mar. 23, 2018 and is hereby incorporated herein by reference in its entirety.

FIELD OF THE DISCLOSURE

The present disclosure relates generally to guards and, in particular, relates to guards for use with power tools and power tools including such guards.

BACKGROUND

Hand-guided electrical tools, such as angle grinders, are often used in metal fabrication. To this end, angle grinders may utilize various abrasives. In some cases, angle grinders may utilize a fiber pad to flatten and polish welds and to clean and prepare metal surfaces for other operations. The fiber pad typically resembles a circle of sandpaper and may be held on the angle grinder by a flat rubber fixture that supports the back surface of the fiber pad.

SUMMARY

In accordance with a first example, a guard for use with a power tool includes a collar structured to be removably coupled to the power tool. A hood is coupled to the collar. A guard ring coupled to the collar via the hood. The guard ring extends entirely around the collar.

In accordance with a second example, a guard includes a collar structured to be removably coupled to a power tool having a rotatable component. A hood is coupled to the collar. A guard ring is coupled to the hood and at least partially surrounds the collar. The guard ring is structured to enable a first amount of the rotatable component to be exposed at a first end of the rotatable component and for a second amount of the rotatable component to be exposed at a second end of the rotatable component. The first amount being greater than the second amount. The second end is opposite the first end. The guard is structured to surround at least a portion of the rotatable component adjacent the first end and to surround at least a portion of the rotatable component adjacent the second end.

In accordance with a third example, a power tool includes a body and a guard. The guard includes a collar structured to be removably coupled to the body. A hood is coupled to the collar. A guard ring is coupled to the collar via the hood. The guard ring extends entirely around the collar.

In further accordance with the foregoing first, second and/or third examples, an apparatus and/or method may further include any one or more of the following:

In accordance with one example, the hood is structured to cover a portion of a rotatable component of the power tool when the guard is coupled to the power tool.

In accordance with another example, the guard includes a support coupled between the guard ring and the hood adjacent the collar.

In accordance with another example, the support is a first support, further including a second support coupled between the guard ring and the hood. A window is defined between the first and second supports to enable visibility of a rotatable component of the power tool when the guard is coupled to the power tool.

In accordance with another example, the window is a first window and the guard includes a second window and a third window. The second window is defined between the first support and the hood. The third window is defined between the second support and the hood. The second window is disposed between the first and third windows.

In accordance with another example, the hood includes a first portion extending from the collar and a second portion extending from the first portion and tapering toward the guard ring.

In accordance with another example, the guard ring is structured to enable a rotatable component of the power tool to extend past the guard ring to enable the rotatable component to contact a working surface.

In accordance with another example, the guard ring is structured to deter a rotatable component of the power tool from contacting a working surface when the guard is coupled to the power tool and when a relative angle between the rotatable component and the working surface satisfies a threshold.

In accordance with another example, a first surface of the guard ring is non-parallel relative to a second surface of the collar to enable a rotatable component of the power tool to extend past the first surface. The first surface opposite the second surface.

In accordance with another example. The guard ring is angled relative to a horizontal plane extending through the guard.

In accordance with another example, the guard further includes a support extending between the hood and the guard ring. The support is structured to increase structural rigidity of the guard ring.

In accordance with another example, the guard includes a window defined between the guard ring and the hood to enable visibility of the rotatable component of the power tool when the guard is coupled to the power tool.

In accordance with another example, the guard is structured to deter the rotatable component from contacting a working surface when a relative angle between the rotatable component and the working surface satisfies a threshold.

In accordance with another example, the guard ring is non-parallel relative to an exterior facing surface of the collar.

In accordance with another example, the collar includes a first surface and the guard ring includes a second surface. The first and second surfaces are non-parallel relative to one another.

In accordance with another example, the power tool includes a window defined between the guard ring and the collar to enable visibility of a rotatable component of the power tool.

In accordance with another example, the power tool includes first and second supports extending between the hood and the guard ring. The first and second supports configured to increase structural rigidity of the hood.

In accordance with another example, the guard ring is structured to enable a rotatable component of the power tool to extend past the guard ring to enable the rotatable component to contact a working surface.

DETAILED DESCRIPTION

Figure 1:
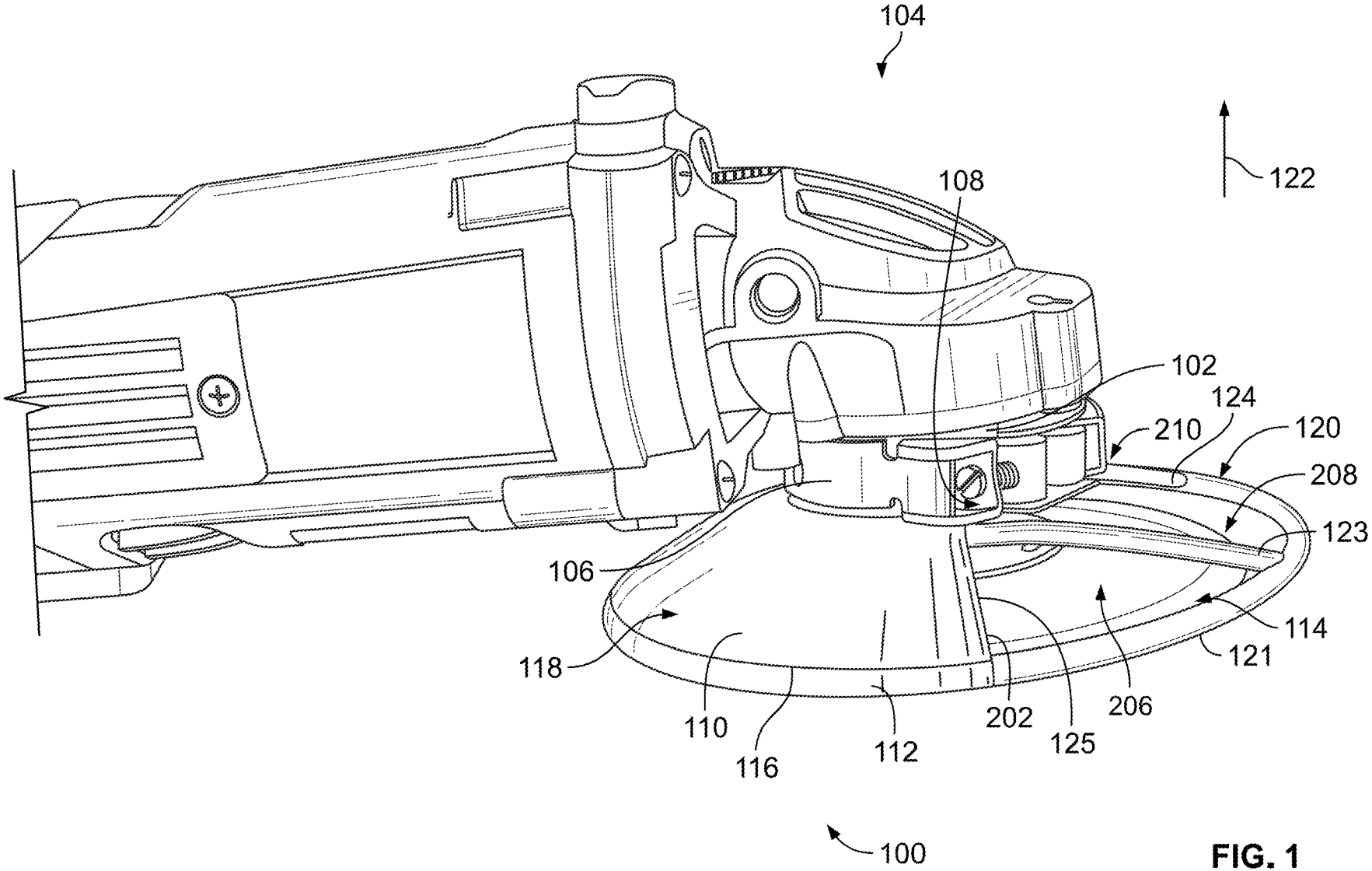
FIG. 1 illustrates an isometric view of an example guard carried by an example hand-guided electrical tool.

Although the following text discloses a detailed description of example methods, apparatus and/or articles of manufacture, it should be understood that the legal scope of the property right is defined by the words of the claims set forth at the end of this patent. Accordingly, the following detailed description is to be construed as examples only and does not describe every possible example, as describing every possible example would be impractical, if not impossible. Numerous alternative examples could be implemented, using either current technology or technology developed after the filing date of this patent. It is envisioned that such alternative examples would still fall within the scope of the claims.

It is known to equip angle grinders with a guard for protecting an operator of the tool against injury from, for example, the fiber pad or other abrasive. However, known guards protect only a portion of the circumference of the abrasive, such that these known guards only protect against some types of hazards associated with the use of the abrasive. Specifically, some known guards extend around 180° or less of the abrasive of an angle grinder and/or extend below a bottom plane of the abrasive, covering a portion of the bottom surface of the abrasive. As a result, the guarded edge of the abrasive used in association with some known guards is raised higher than the height of the guards, limiting how flat, or how low an angle, the unguarded portion of the abrasive can be held against the surface being polished and/or worked. To enable particular types of work be accomplished, in some instances, an operator may choose to remove the known guard from the angle grinder against manufacturer safety instructions, thereby creating a safety hazard and defeating the purpose of equipping the angle grinder with a guard all together.

To address some of the problems encountered with known guards used with angle grinders or other power tools, the examples disclosed herein relate to guards that are structured to deter damage to the surface being worked, enable operations using the tools to be performed at relatively low angles and increase the safety associated with operating such tools. The tools may be electric-powered tools, hydraulic-powered tools, pneumatic-powered tools, gas-powered tools, etc.

To deter the guard ring from interfering with an ability of the abrasive to come into contact with a work surface, in some examples, the guard ring extends close to, but not below, a plane defined by a bottom surface of the abrasive of the grinder. Specifically, to enable the abrasive (which may also be referred to as the polishing wheel or the grinding wheel) to be accessible to work a surface, in some examples, the guard ring is angled relative to a horizontal plane of the abrasive such that a portion of the guard ring (e.g., the back of the guard ring) is located below another opposite portion of the guard ring (e.g., the front of the guard ring). In turn, in some examples, guards as disclosed herein do not interfere with using grinders or other hand-guided electrical tools at low angles while also surrounding more of the abrasive as compared to some known guards that cover 180° of the abrasive or less than 180° of the abrasive.

In some examples, the guard includes a hood, a clamp and a guard ring that extends entirely around the clamp. In some examples, the guard includes at least one stiffener arranged between the hood and a portion of the guard ring. For example, the guard may include two stiffeners extending between the guard ring and the hood. However, in other examples, the guard does not include a stiffener extending between the hood and the guard ring and/or includes any other number of stiffeners. Regardless of the number of stiffeners included, the stiffeners may be coupled to the hood and the guard ring in any suitable way. For example, the stiffeners may be coupled to the hood and/or the guard ring using a weld or adhesive, or the components of the guard may be integrally formed. In such examples, the guard may be formed using additive manufacturing processes, extruding processes, 3D-printing methods, forging processes, casting processes, etc. using materials such as, for example, metal, plastic, etc.

FIG. 1 illustrates an example guard 100 coupled to an example mount 102 of an example hand-guided electrical tool 104. The tool 104 is shown implemented as an angle grinder, though other hand-guided electrical tools may be used instead. In the illustrated example, the guard 100 includes an example collar 106 having an example clamp 108, an example hood 110 and an example guard ring 112 coupled to the collar 106 via the hood 110. In this example, the guard ring 112 extends around the entire circumference of the collar 106 and the clamp 108.

As shown, the hood 110 angles away from the collar 106 to enable a rotatable component of the tool 104 in the form of an abrasive disk 114 to be at least partially disposed within a dimensional envelope of the guard 100 and to enable the guard ring 112 to be coupled to a lower facing surface 116 of the hood 110. In this example, the guard ring 112 is integrally formed with the hood 110, though in other examples, the hood 110 and the guard ring 112 can be separately manufactured and coupled to one another via any known manner (e.g., welding, adhesive). While the example of FIG. 1 illustrates the tool 104 including the disk 114, the tool 104 may include any other rotatable component (e.g., a wire wheel brush).

In the illustrated example, the hood 110 is structured to cover a first portion or half 118 of the disk 114 and is structured not to cover a second portion or half 120 of the disk 114. To further increase the safety of operating the tool 104, in this example, the guard ring 112 is structured to surround the first half 118 of the disk 114 and the second half 120 of the disk 114, where the first half 118 is disposed opposite the second half 120. To enable the disk 114 to engage a working surface, a lower surface 121 of the guard ring 112 is angled in a direction generally indicated by arrow 122, such that the guard ring 112 is angled relative to the horizontal (and the disk 114), thereby enabling at least a portion of the disk 114 to be uncovered (e.g., exposed). Thus, in the illustrated example, the disk 114 protrudes from the guard 100 in a direction generally opposite that of the arrow 122 relative to the lower surface 121.

To support the portion of the guard ring 112 surrounding the second half 120 of the disk 114, example first and second supports in the form of stiffeners 123, 124 are coupled between the guard ring 112 and an edge 125 of the hood 110. To enable an operator of the tool 104 to have visibility of the working surface and the disk 114 itself, in this example, the hood 110, the guard ring 112 and the stiffeners 123, 124 are structured to define example first, second and third windows 206, 208, 210, where the second window 208 is disposed between the first and third windows 206, 200.

Figure 2:
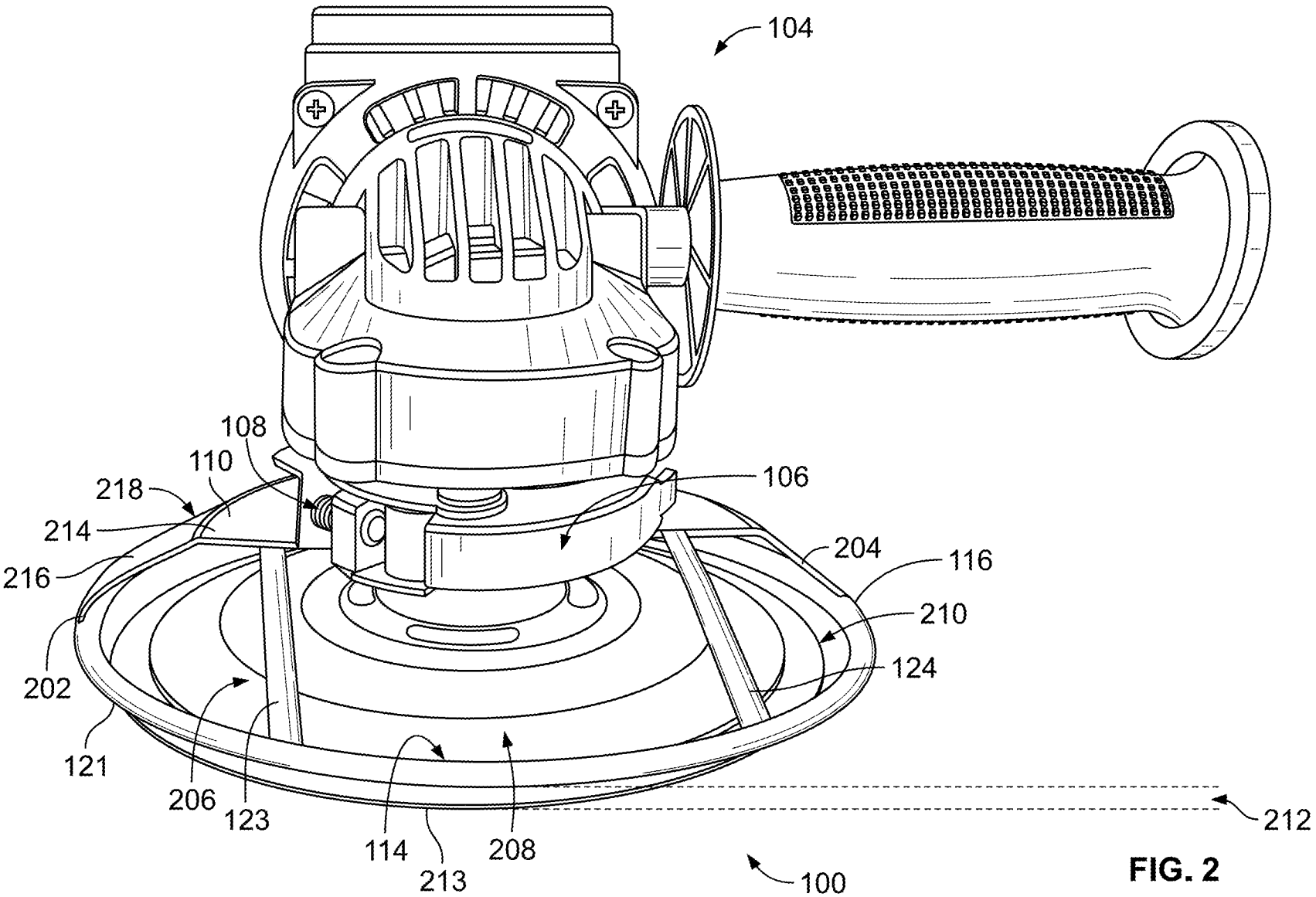
FIG. 2 illustrates another isometric view of the guard of FIG. 1 carried by the hand-guided electrical tool of FIG. 1.

FIG. 2 illustrates another isometric view of the example guard 100 coupled to the tool 104. As shown, the guard ring 112 extends entirely around the circumference of the collar 106 enabling a portion of the guard ring 112 to extend between ends 202, 204 of the hood 110. As also shown, the disk 114 extends below the lower surface 121 of the guard ring 112. Thus, a first distance 212 is provided between a first portion (front) of the lower surface 121 of the guard ring 112 and a lower surface 213 of the disk 114 to enable the disk 114 to easily contact a working surface, and a second distance is provided between a second portion (rear) of the lower surface 121 and the lower surface 213, the second distance being less than the first distance 212. In the illustrated example, the hood 110 includes a first surface 214 extending from the collar 106 and a second surface 216 angling from an end 218 of the first surface 214 toward the guard ring 112. The example shown in FIG. 2 also illustrates the coupling between the guard ring 112 and the hood 110 at the lower facing surface 116 of the hood 110.

As shown, at least in this example, the first and third windows 206, 210 are approximately the same size and are approximately mirror images of one another, and the second window 206 is a different size than the first and third windows 206, 210. As set forth herein, the phrase "approximately the same size" means that the sizes of the windows are within 5% of each other to account for manufacturing tolerances. As set forth herein, the phrase "approximately mirror images of one another" accounts for manufacturing tolerances.

Figure 3:
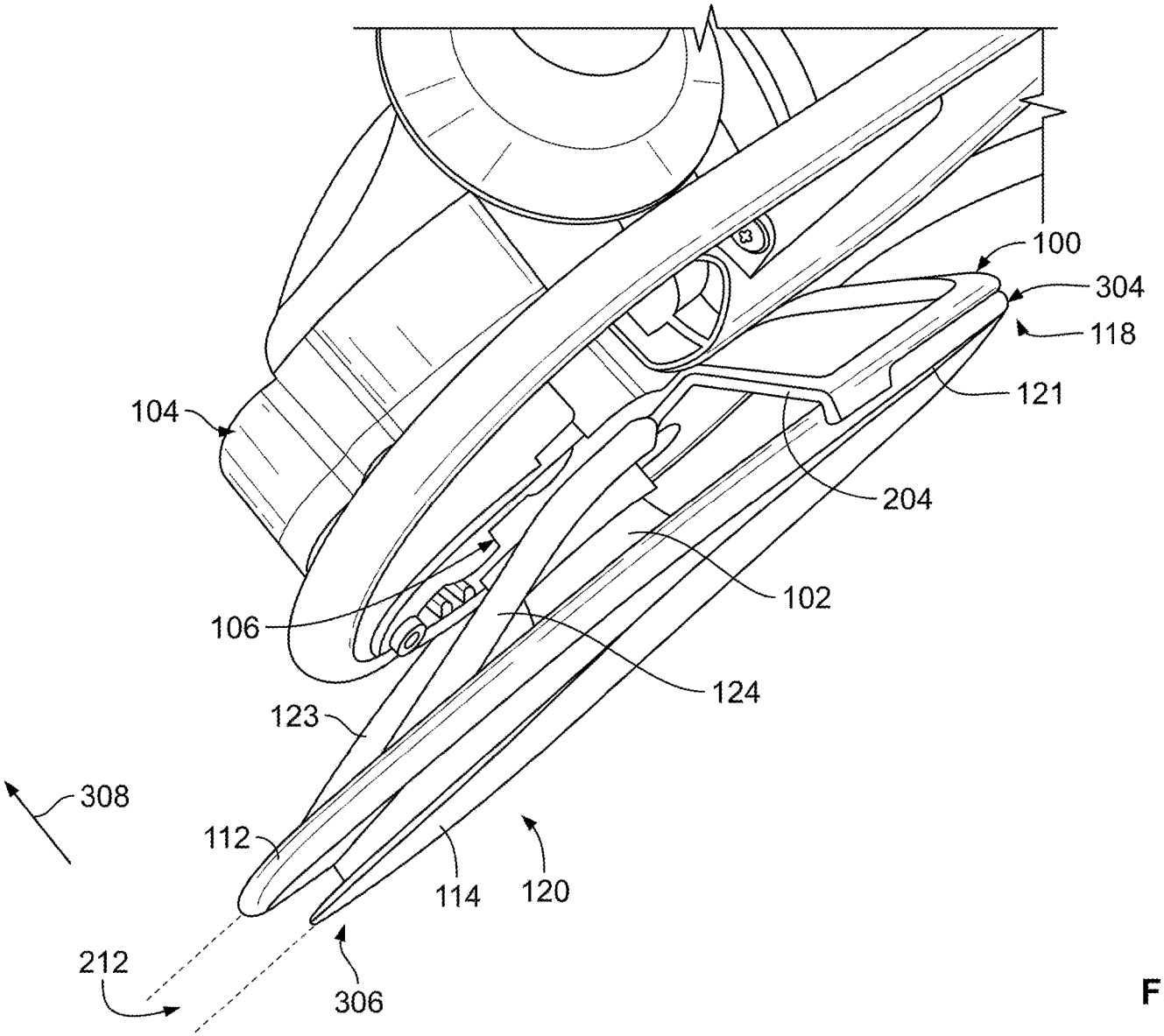
FIG. 3 illustrates another isometric view of the guard of FIG. 1 carried by the hand-guided electrical tool of FIG. 1.

FIG. 3 illustrates another isometric view of the example guard 100 coupled to the mount 102 of the tool 104 of FIG. 1. In this example, to incrementally or gradually expose more of the disk 114, the guard ring 112 is shown angling from a first end 304 of the guard ring 112 toward a second end 306 of the guard ring 112 in a direction generally indicated by arrow 308. In this example, the guard ring 112 is angled relative to the disk 114 (or the horizontal) at approximately 10°, though in other examples, any other angle may be utilized. As set forth herein, the phrase "approximately 10°" means +/−4° of 10° to account for manufacturing tolerances.

Further, while the example of FIG. 3 illustrates the guard ring 112 surrounding the entire disk 114, in other examples, the guard ring 112 can be implemented by an arc-shaped guard that is coupled at and between the ends 202, 204 of the hood 110. In such examples, the arc-shaped guard surrounds the second half 120 of the disk 114 but does not entirely surround the first half 118 of the disk 114. In some such examples, a lower surface of the hood 110 is substantially parallel to an opposing surface of the collar 106 and the arc-shaped guard ring 112 angles from the lower surface of the hood 110 toward the front of the disk 114, thereby exposing the disk 114. Put another way, the lower surface of the hood 110 and the guard ring 112 are disposed at an angle greater than 0° relative to one another. As set forth herein, the phrase "substantially parallel" means +/−5° of parallel and/or accounts for manufacturing tolerances.

Figure 4:
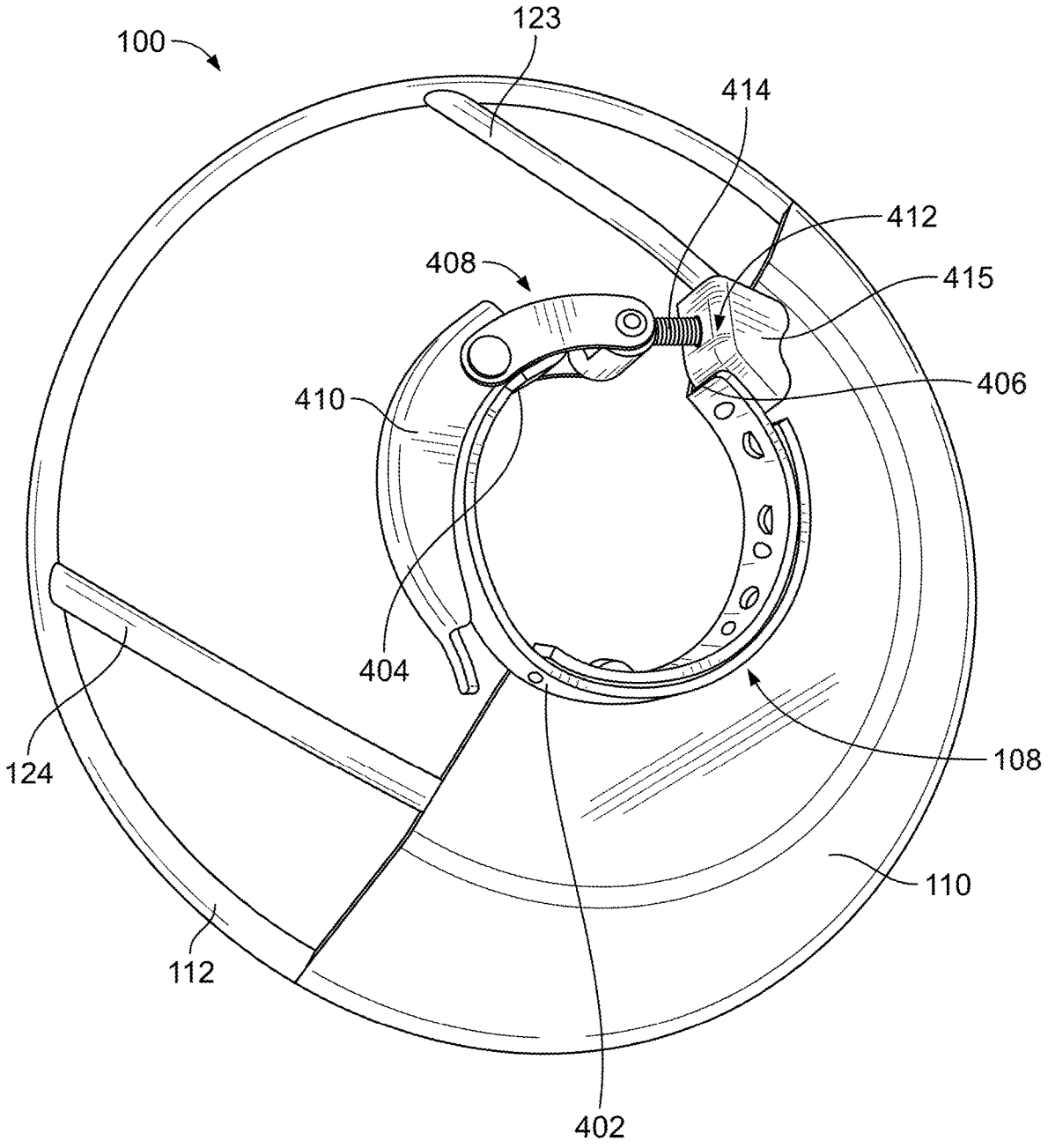
FIG. 4 illustrates an isometric view of the guard of FIG. 1.

FIG. 4 illustrates an isometric view of the example guard 100 of FIG. 1. As shown, the guard 100 includes the clamp 108, the hood 110 and the guard ring 112. In this example, the clamp 108 includes an example open ring 402 having ends 404, 406 that are coupled by an example link 408 including a handle 410. To actuate the clamp 108 from the closed position shown in FIG. 4 to an open position shown in FIG. 8, the handle 410 is rotated clockwise. To actuate the clamp 108 from the open position to the closed position, the handle 410 is rotated counter clockwise.

To accommodate different sized tool mounts, in this example, the clamp 108 includes an adjuster 412. As shown, the adjuster 412 includes a threaded fastener 414 that threadably engages the link 408 and a bracket 415 at the end 406 of the open ring 402. To increase the diameter of the clamp 108, the threaded fastener 414 is rotated in a first direction and to decrease the diameter of the clamp 108, the threaded fastener 414 is rotated in a second direction opposite the first direction.

Figure 5:
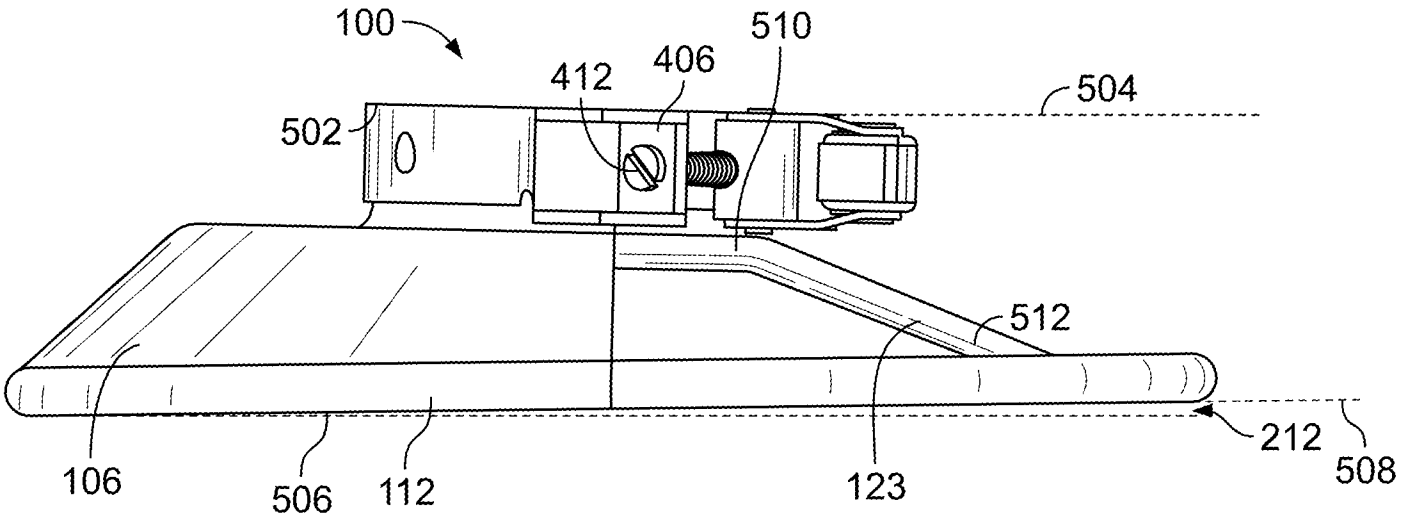
FIG. 5 illustrates an elevated view of a right side of the guard of FIG. 1.
Figure 6:
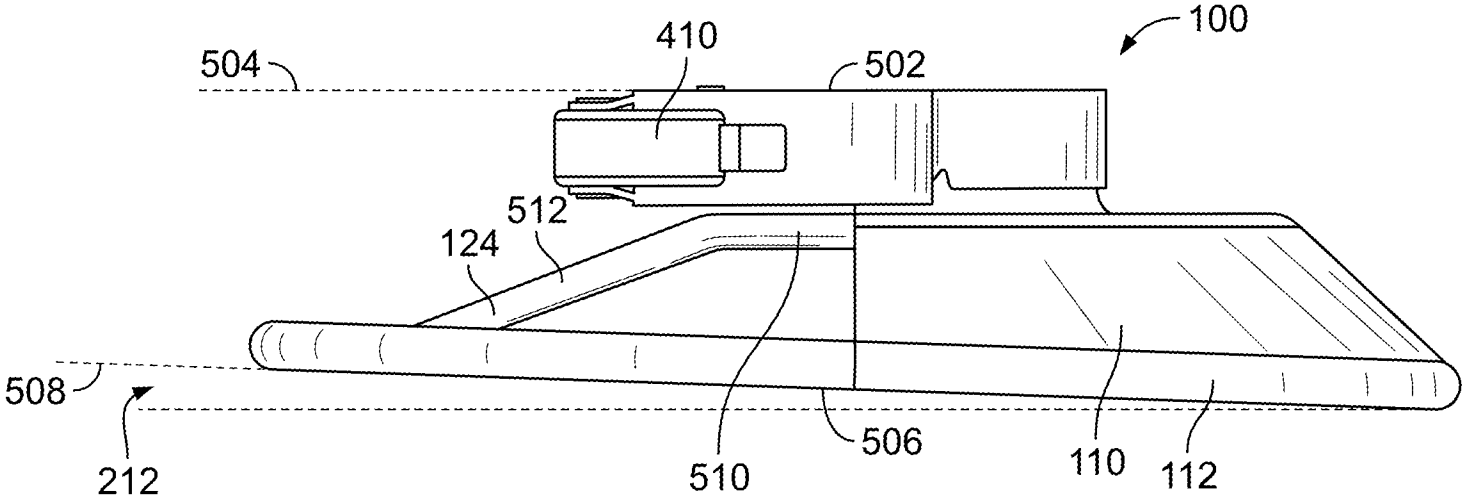
FIG. 6 illustrates an elevated view of a left side of the guard of FIG. 1.

FIGS. 5 and 6 illustrate opposing side elevated views of the example guard 100. As shown, a surface 502 of the collar 106 defines a first plane 504 and a downward facing surface 506 of the guard ring 112 defines a second plane 508, where the planes 504, 508 are non-parallel relative to one another and the second plane 508 is angled relative to the horizontal. In these examples, the stiffeners 123, 124 are shown including an example first portion 510 and an example second portion 512, where the first portion 510 is coupled to and extends radially outwardly from the hood 110 and the second portion 512 angles from the first portion 510 and is coupled to the guard ring 112.

Figure 7:
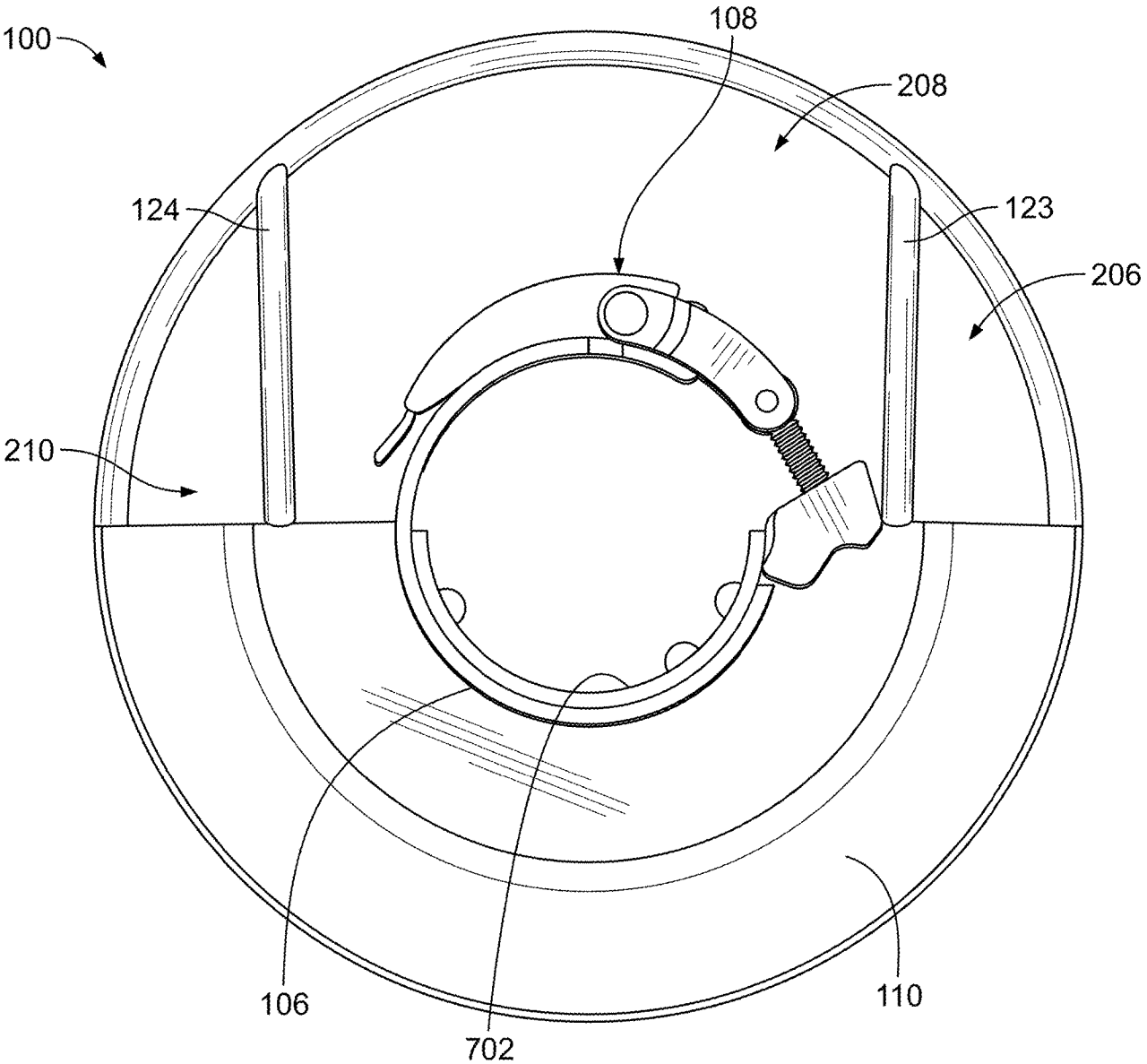
FIG. 7 illustrates a plan top view of the guard of FIG. 1 showing an example clamp in a closed position.
Figure 8:
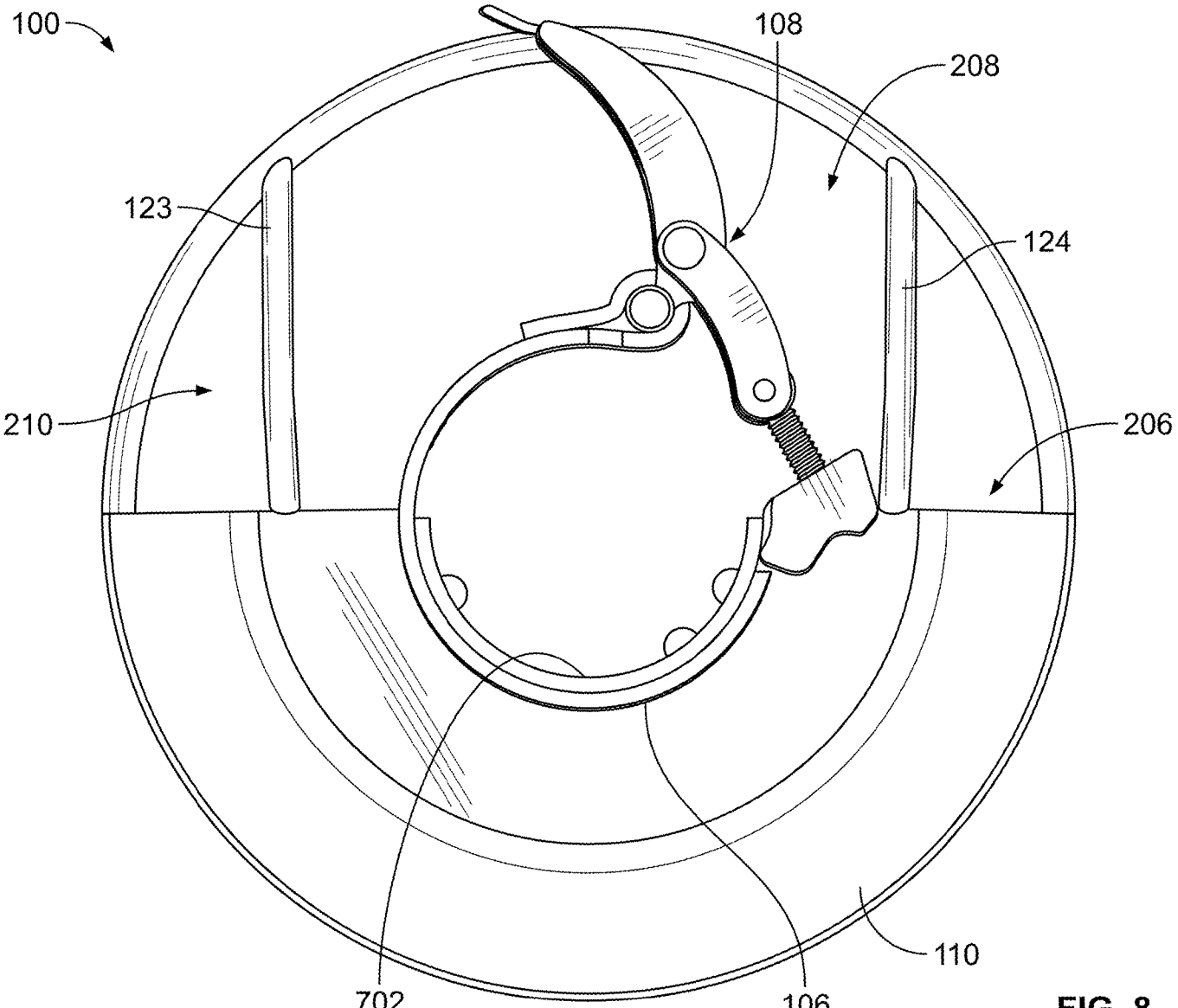
FIG. 8 illustrates a plan top view of the guard of FIG. 1 showing the example clamp in the open position.

FIGS. 7 and 8 illustrate top plan views of the guard 100 showing the first, second and third windows 206, 208, 210 and an example aperture 702 of the collar 106 that is structured to receive the mount of a hand-guided electrical tool such as the tool 104 of FIG. 1. FIG. 7 illustrates the clamp 108 in a closed position. FIG. 8 illustrates the clamp 108 in an open position.

Figure 9:
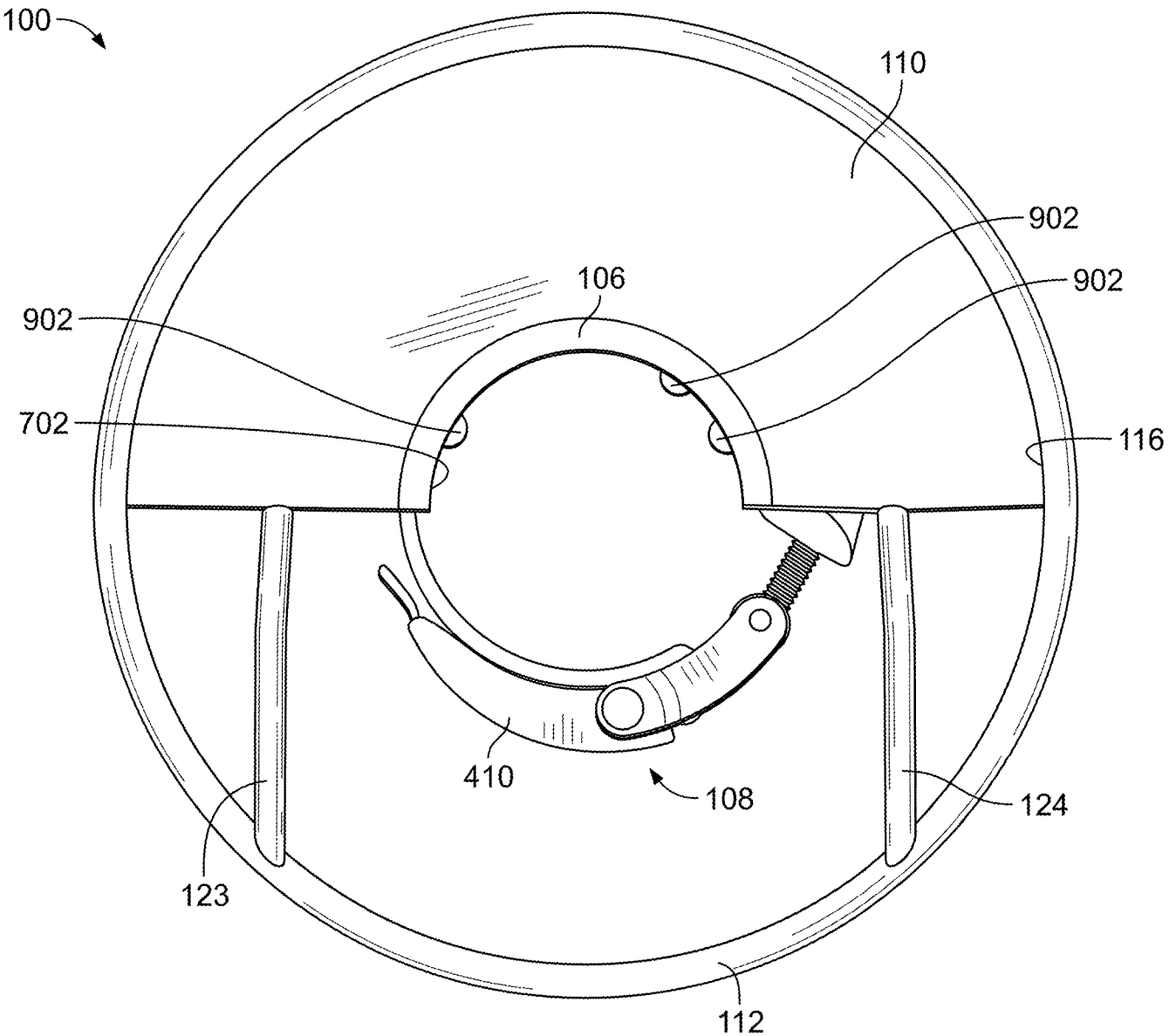
FIG. 9 illustrates a plan bottom view of the guard of FIG. 1 showing the example clamp in the closed position.
Figure 10:
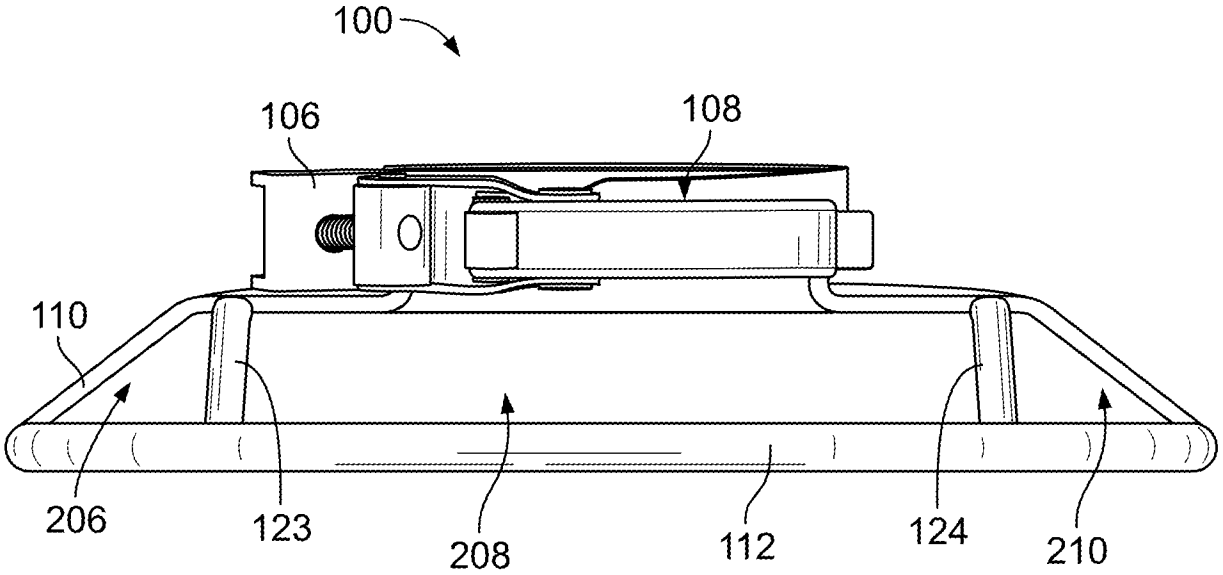
FIG. 10 illustrates an elevated view of a front side of the guard of FIG. 1.
Figure 11:
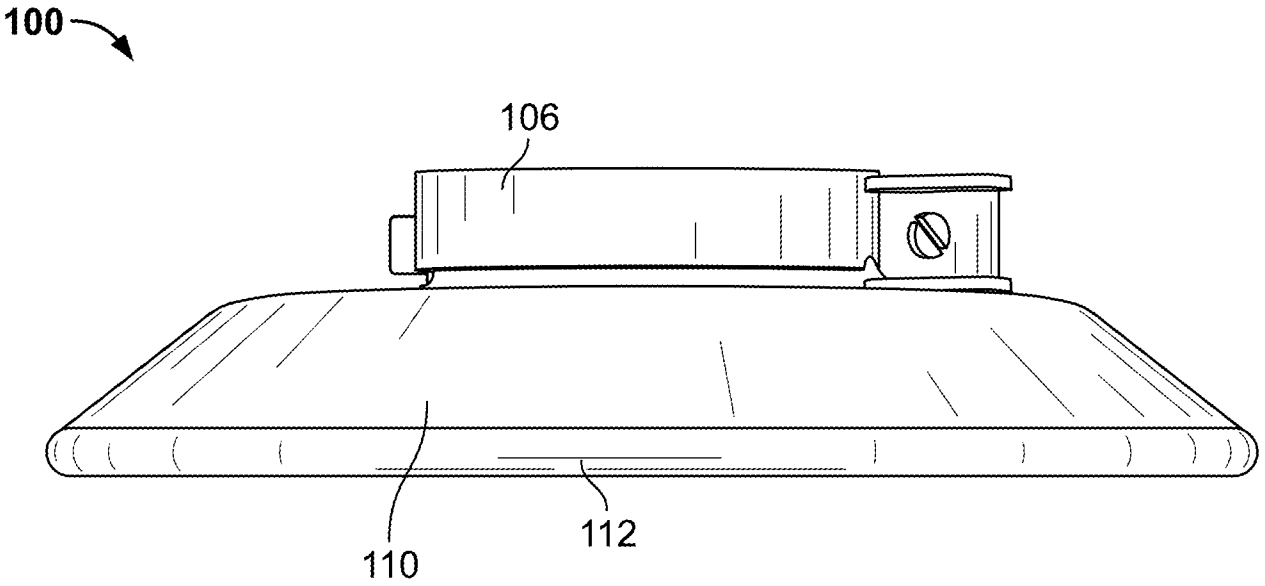
FIG. 11 illustrates an elevated view of a rear side of the guard of FIG. 1.

FIG. 9 illustrates a bottom plan view of the guard 100 showing the guard ring 112 encircling the aperture 702 and coupled at the lower surface 116 of the hood 110. In this example, protrusions 902 of the collar 106 are shown extending into the aperture 702. In some examples, the protrusions 902 are received in corresponding apertures of the mount of the hand-guided electrical tool to rotationally locate and fix the guard 100 on the hand-guided electrical tool. In other examples, the protrusions 902 are structured to engage a cylindrical surface of the mount of the hand-guided electrical tool to deter the guard 100 from rotating in use. FIG. 10 illustrates a front view of the guard 100 showing the windows 206, 208, 210 defined by the hood 110, the collar 106, the guard ring 112 and the stiffeners 123, 124. FIG. 11 illustrates a rear view of the guard 100 showing the coupling between the collar 106 and the hood 110 and the coupling between the hood 110 and the guard ring 112.

Figure 12:
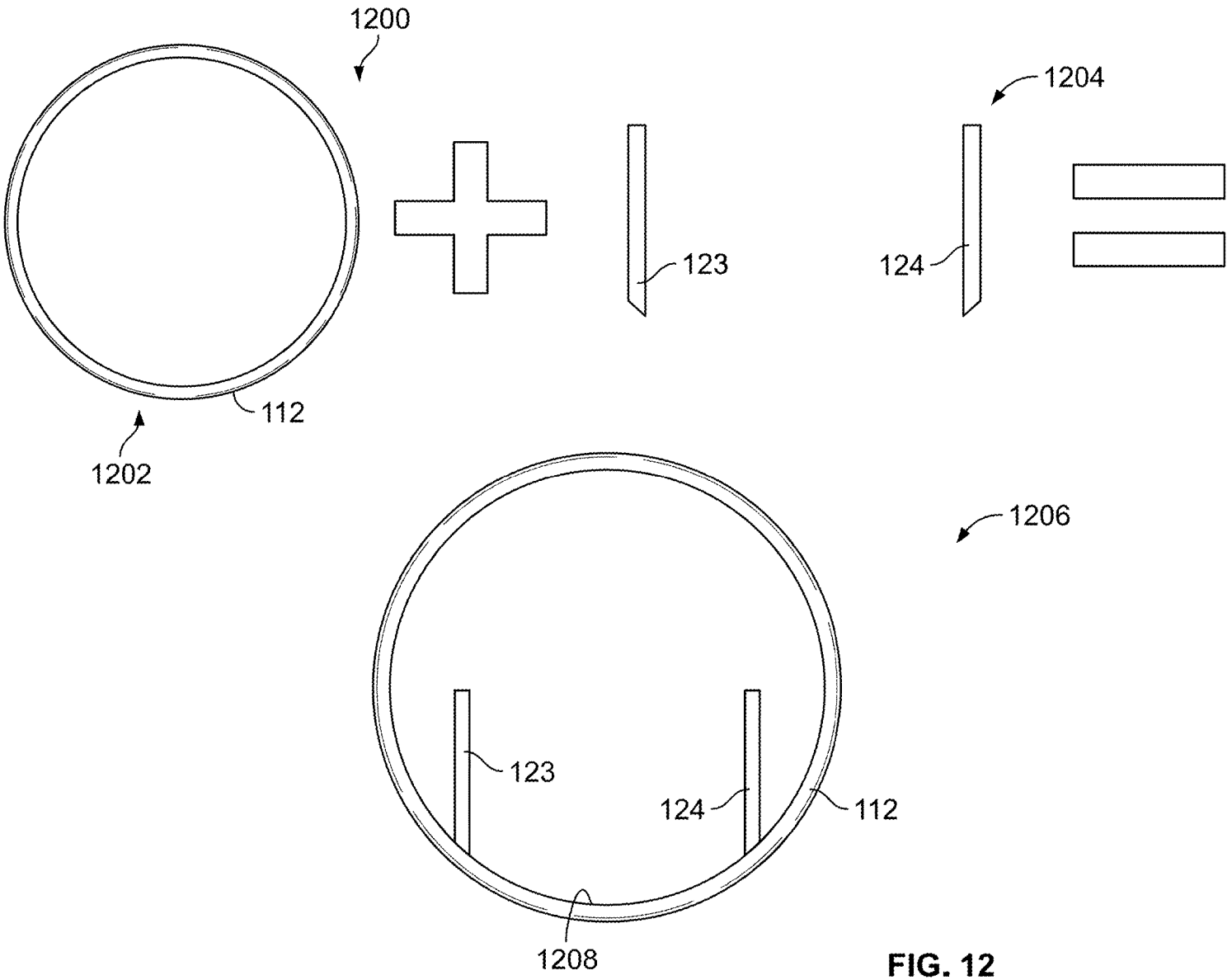
FIG. 12 illustrates a workflow of an example method for producing an example guard including example stiffeners in accordance with the teachings of this disclosure.
Figure 13:
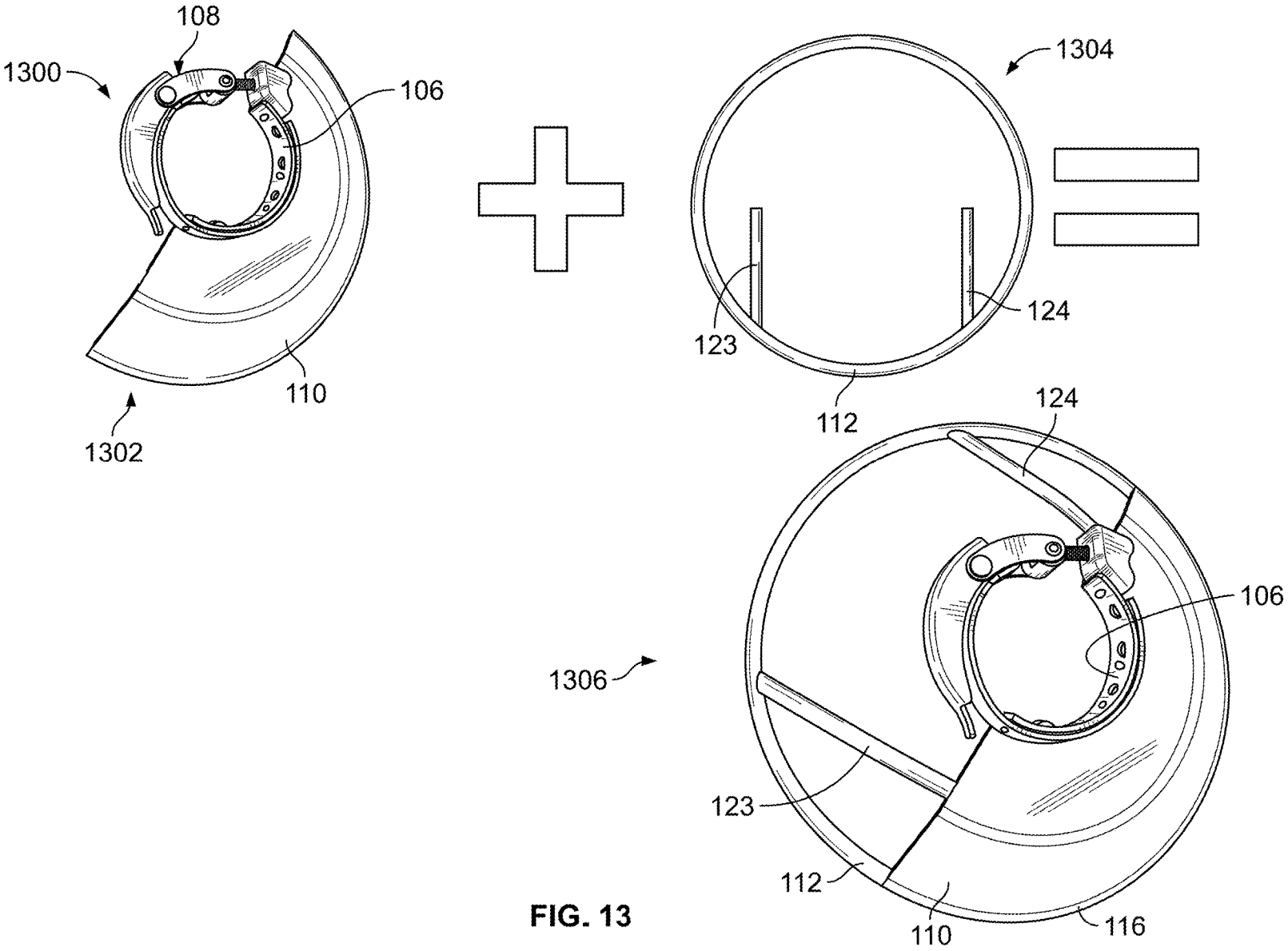
FIG. 13 illustrates a workflow of an example method for producing an example guard in accordance with the teachings of this disclosure.

FIGS. 12 and 13 illustrate example workflows of example methods 1200, 1300 to produce the examples disclosed herein. FIG. 12 illustrates the method 1200 of producing the example guard ring 112 including the stiffeners 123, 124 of FIG. 1. Reference number 1202 illustrates the guard ring 112, reference number 1204 illustrates the stiffeners 123, 124 and reference number 1206 illustrates the stiffeners 123, 124 coupled to the guard ring 112. As shown, the stiffeners 123, 124 are coupled to an inward facing surface 1208 of the guard ring 112 and extend inwardly relative to the guard ring 112. While the stiffeners 123, 124 are shown as being parallel to one another, the stiffeners 123, 124 can be disposed at any angle relative to one another. In some examples, the stiffeners 123, 124 are welded to the guard ring 112. However, the stiffeners 123, 124 may be coupled to the guard ring 112 in any other suitable way.

FIG. 13 illustrates the method 1300 of producing the example guard 100 of FIG. 1. Reference number 1302 illustrates the hood 110 coupled to the collar 106 and the clamp 108, reference number 1304 illustrates the stiffeners 123, 124 coupled to the guard ring 112 and reference number 1306 illustrates the guard ring 112 and the stiffeners 123, 124 coupled to the hood 110. As shown, the guard ring 112 is coupled to the lower surface 116 of the hood 110 and the stiffeners 123, 124 are coupled to the hood 110 adjacent the collar 106. In some examples, the guard ring 112 is welded to the hood 110 and the stiffeners 123, 124 are welded to the hood 110. However, the guard ring 112 can be coupled to the hood 110 and/or the stiffeners 123, 124 can be coupled to the hood 110 in any other suitable way.

The examples disclosed herein relate to example guards that are structured to protect an abrasive (e.g., a fiber pad) of a hand-guided electrical tool around its entire circumference but also to protect an operator of the hand-guided electrical tool by deterring debris from impacting the operator using a hand-guided electrical tool implemented with the teachings of this disclosure. Moreover, the examples disclosed herein deter an object (e.g., clothing, etc.) from becoming ensnared by the rotating abrasive carried by the hand-guided electrical tool. At the same time, the guards are structured to enable the hand-guided electrical tool to be used at relatively low angles while providing visibility of the working surface to the operator of the hand-guided electrical tool. Thus, the example guards enable the hand-guided electrical tool to work a surface when a threshold angle (e.g., a relatively low angle) is satisfied. To deter damage of the work surface associated with using angle grinders at a relatively high, i.e., steep, angle, in some examples, the guard is structured to engage the work surface if a threshold angle is satisfied. Put another way, the example guard prevents the abrasive from grabbing and/or biting into the metal surface, which may cause an operator to have reduced control of the angle grinder.

An example guard as disclosed herein includes an example collar having a clamp, an example guard ring and an example hood that extends between and is coupled to the collar and the guard ring. In some examples, the guard ring may surround 360° of the clamp or the guard ring may surround greater than 180° and less than 360° of the clamp. In some examples, the hood is a semi-annular hood and is structured to extend around approximately 180° of the guard ring. In other examples, the hood extends around less than 180° of the guard ring or extends around greater than 180° of the guard ring. To increase the structural rigidity of the guard ring, in some examples, one or more supports extend between the hood adjacent the collar and the guard ring.

To enable access to the disk for grinding and/or polishing purposes, the guard ring is angled relative to the horizontal to enable the abrasive to extend from a dimensional envelope of the guard. Put another way, a first portion of the guard including the hood covers more of a lateral edge of the abrasive as compared to a second portion of the guard. When coupled to an angle grinder, the first portion of the guard is typically positioned toward the rear of the grinder, i.e., adjacent the handle of the grinder, and the second portion of the guard is typically positioned toward the front of the grinder, sometimes referred to as the business end of the grinder.

While the hood, the guard ring, the stiffeners and/or the guard itself may be made of any suitable material including plastics, in some examples, the hood is made using 12 gauge steel and the guard ring and/or the stiffeners are made of Stainless Steel (e.g., 304 Stainless Steel). In other examples, however, the hood, the guard ring and/or at least one stiffener is made of a different material. As an example, the hood, the guard ring and/or the at least one stiffener can be made of the same material such as, for example, 304 Stainless Steel.

The guards disclosed herein are structured to be coupled to hand-guided electrical tools such as, for example, a right angle grinder equipped with an abrasive in the form of a fiber pad for polishing a metal surface. In some examples, when the guard is coupled to a right angle grinder (e.g., via an example clamp), the guard ring extends around an entire circumference of the abrasive, thereby protecting the full circumference of the abrasive. In other examples, the guard ring partially extends around the circumference of the abrasive. For example, the guard ring may extend around the circumference of the guard ring greater than 180° of the abrasive but less than 360° of the abrasive.

The figures are not to scale and the same reference numbers may be used to describe like or similar parts. Further, while several examples have been disclosed herein, any features from any examples may be combined with or replaced by other features from other examples. Moreover, while several examples have been disclosed herein, changes may be made to the disclosed examples within departing from the scope of the claims.

The invention claimed is:

1. A guard for use with a power tool, the guard comprising:

a collar structured to be removably coupled to a power tool;

a hood coupled to the collar;

a guard ring coupled to the collar via the hood, the guard ring extending entirely around a circumference of a rotatable component of the power tool when the guard is coupled to the power tool; and a support coupled between the guard ring and the hood adjacent the collar.

2. The guard of claim 1, wherein the support is a first support, further including a second support coupled between the guard ring and the hood, and further including a window defined between the first and second supports to enable visibility of the rotatable component of the power tool when the guard is coupled to the power tool.

3. The guard of claim 2, wherein the window is a first window, further including a second window and a third window, the second window being defined between the first support and the hood, the third window being defined between the second support and the hood, the second window disposed between the first and third windows.

4. A guard for use with a power tool, the guard comprising:

a collar structured to be removably coupled to a power tool;

a hood coupled to the collar; and a guard ring coupled to the collar via the hood, the guard ring extending entirely around a circumference of a rotatable component of the power tool when the guard is coupled to the power tool, wherein the hood includes a first portion extending from the collar and a second portion extending from the first portion and tapering toward the guard ring.

5. A guard, comprising:

a collar structured to be removably coupled to a power tool having a rotatable component;

a hood coupled to the collar;

a guard ring coupled to the hood and at least partially surrounding the collar, the guard ring structured to enable a first amount of the rotatable component to be exposed at a first lateral end of the rotatable component and for a second amount of the rotatable component to be exposed at a second lateral end of the rotatable component, the first amount being greater than the second amount, the second lateral end opposite the first lateral end, the guard structured to surround at least a portion of the rotatable component adjacent the first lateral end and to surround at least a portion of the rotatable component adjacent the second lateral end; and a support extending between the hood and the guard ring, the support structured to increase structural rigidity of the guard ring.

6. A guard, comprising:

a collar structured to be removably coupled to a power tool having a rotatable component;

a hood coupled to the collar;

a guard ring coupled to the hood and at least partially surrounding the collar, the guard ring structured to enable a first amount of the rotatable component to be exposed at a first lateral end of the rotatable component and for a second amount of the rotatable component to be exposed at a second lateral end of the rotatable component, the first amount being greater than the second amount, the second lateral end opposite the first lateral end, the guard structured to surround at least a portion of the rotatable component adjacent the first lateral end and to surround at least a portion of the rotatable component adjacent the second lateral end; and a window defined between the guard ring and the hood to enable visibility of the rotatable component of the power tool when the guard is coupled to the power tool.

7. A power tool, comprising:

a body;

a rotatable component; and a guard, comprising:

a collar structured to be removably coupled to the body;

a hood coupled to the collar;

a guard ring coupled to the collar via the hood, the guard ring extending entirely around a circumference of the rotatable component of the power tool when the guard is coupled to the power tool; and a window defined between the guard ring and the collar to enable visibility of the rotatable component of the power tool.

8. A power tool, comprising:

a body;

a rotatable component; and a guard, comprising:

a collar structured to be removably coupled to the body;

a hood coupled to the collar;

a guard ring coupled to the collar via the hood, the guard ring extending entirely around a circumference of the rotatable component of the power tool when the guard is coupled to the power tool; and first and second supports extending between the hood and the guard ring, the first and second supports configured to increase structural rigidity of the hood.

* * * * *